US009273936B2

(12) United States Patent
Jackson

(10) Patent No.: US 9,273,936 B2
(45) Date of Patent: Mar. 1, 2016

(54) HOVERBALL ARCHERY TRAINING AND ENTERTAINMENT SHOOTING GALLERY AND KIT

(71) Applicant: Deerspace, LLC, Waterloo, IN (US)

(72) Inventor: John Jackson, Waterloo, IN (US)

(73) Assignee: John Jackson, Waterloo, IN (US)

( * ) Notice: Subject to any disclaimer, the term of this patent is extended or adjusted under 35 U.S.C. 154(b) by 0 days.

(21) Appl. No.: 14/277,372

(22) Filed: May 14, 2014

(65) Prior Publication Data

US 2015/0330746 A1 Nov. 19, 2015

(51) Int. Cl.
*F41J 1/10* (2006.01)
*F41J 3/00* (2006.01)
*F42B 6/08* (2006.01)

(52) U.S. Cl.
CPC *F41J 1/10* (2013.01); *F41J 3/0004* (2013.01); *F42B 6/08* (2013.01)

(58) Field of Classification Search
CPC ..... A63B 2069/0077; A63B 2069/401; A63B 69/0075; A63B 69/409
USPC ..... 273/359, 367–370, 406, 407; 473/418; 446/179; 40/407
See application file for complete search history.

(56) References Cited

U.S. PATENT DOCUMENTS

| | | | | | |
|---|---|---|---|---|---|
| 1,744,680 | A * | 1/1930 | Sherrill | 40/407 |
| 3,115,343 | A * | 12/1963 | Lemelson | 273/343 |
| 3,869,123 | A * | 3/1975 | McDaniel | 273/359 |
| 3,887,182 | A * | 6/1975 | Breslow | 273/450 |
| 4,045,906 | A * | 9/1977 | Goldfarb et al. | 446/179 |
| 4,345,765 | A * | 8/1982 | Wang | 273/359 |
| 4,564,195 | A * | 1/1986 | McClure et al. | 473/418 |
| 7,846,045 | B1 * | 12/2010 | Kendall | 473/418 |
| 8,100,343 | B2 * | 1/2012 | Michelsen | 239/17 |
| 2002/0198068 | A1 * | 12/2002 | Jordan | 473/418 |
| 2008/0009373 | A1 * | 1/2008 | Binder et al. | 473/418 |

* cited by examiner

*Primary Examiner* — Mark Graham
(74) *Attorney, Agent, or Firm* — Indiano & McConnell LLP

(57) ABSTRACT

In one illustrative form a shooting gallery kit is disclosed that includes a shooting gallery. The shooting gallery comprises an inflatable structure having a base that includes an upper floor; at least one air vent located in said upper floor operable to generate an air stream; at least one target configured to be placed in said air stream such that said target hovers in said air stream; and a blower operable to inflate said inflatable structure and cause said air stream to be emitted from said at least one air vent. A bow and a non-lethal arrow are also included in the kit.

5 Claims, 8 Drawing Sheets

HOVERBALL ARCHERY TRAINING AND ENTERTAINMENT SHOOTING GALLERY AND KIT

BACKGROUND

Archery has become an increasingly popular sport among numerous individuals. As a result, a need exists for ways in which people can experience archery in a safe manner.

DESCRIPTION OF ILLUSTRATIVE EMBODIMENTS

Figure 1:
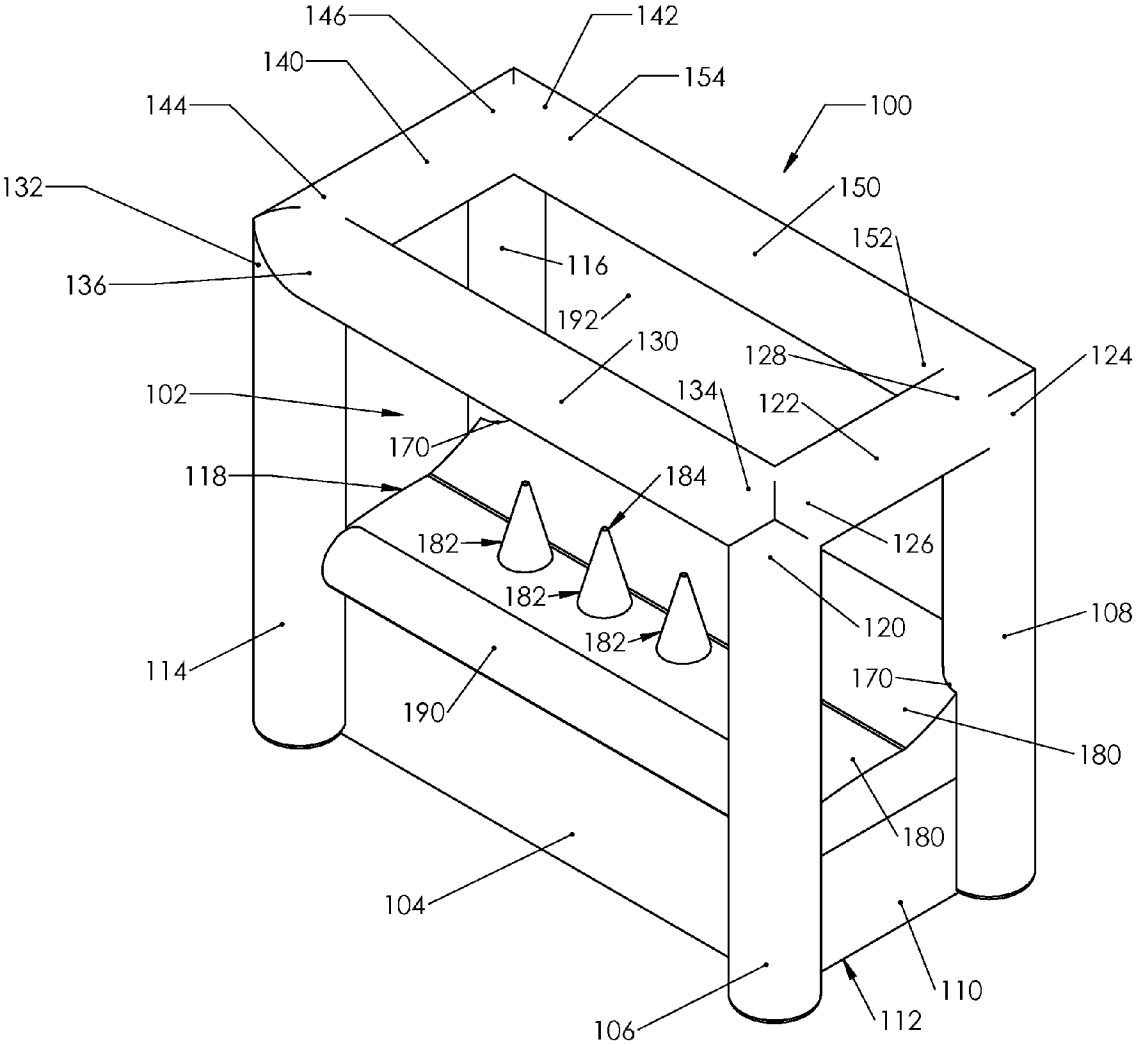
FIG. 1 illustrates a perspective view of a hover ball archery shooting gallery designed for use with non-lethal arrows.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, a representative perspective view of a hover ball archery shooting gallery 100 is illustrated. The shooting gallery 100 consists of an inflatable structure that is configured to cause one or more targets to hover within an interior target area 102. In this form, the shooting gallery 100 has a generally rectangular shape but other shapes could be used in other forms of the invention. The shooting gallery 100 includes a base 104 that is inflated with air. A first front pillar 106 and a first rear pillar 108 are included at a first or right side 110 of the base 104 and extend upwardly from a lower portion 112 of the base 104. A second front pillar 114 and a second rear pillar 116 are included at a second or left side 118 of the base 104 and extend upwardly from the lower portion 112 of the base 104. Although the pillars 106, 108, 114, 116 are illustrated as having a generally cylindrical shape in this representative form, it is envisioned that other shapes may be used in other forms of the invention.

As further illustrated, a first upper end 120 of the first front pillar 106 includes a first medial support member 122 that extends to a second upper end 124 of the first rear pillar 108. A proximal end 126 of the first support medial member 122 is connected with and in fluid communication with the first upper end 120 of the first pillar 106 and a distal end 128 of the first medial support member 122 is connected with and in fluid communication with the second upper end 124 of the first rear pillar 108. In this form, air is the fluid and it is allowed to flow between the first front and rear pillars 106, 108 via the first medial support member 122.

The first upper end 120 of the first front pillar 106 includes a front lateral support member 130 that extends to a third upper end 132 of the second front pillar 114. A proximal end 134 of the front lateral support member 130 is connected with and in fluid communication with the first upper end 120 of the first front pillar 106. A distal end 136 of the front lateral support member 130 is connected with and in fluid communication with the third upper end 132 of the second front pillar 114. As previously set forth, air is the fluid and it is allowed to flow between the first front pillar 106 and the second front pillar 114 via the front lateral support member 130.

A second medial support member 140 is connected with the third upper end 132 of the second front pillar 114 and a fourth upper end 142 of the second rear support pillar 116. A proximal end 144 of the second medial support member 140 is connected with and in fluid communication with the upper end 132 of the second front pillar 114. A distal end 146 of the second medial support member 140 is connected with the fourth upper end 142 of the second rear support pillar 116. As a result, air is allowed to flow between the second front pillar 114 and the second rear pillar 116 via the second medial support member 140.

A rear lateral support member 150 extends between the first rear support pillar 108 and the second rear support pillar 116. A proximal end 152 of the rear lateral support member 150 is connected with and in fluid communication with the upper end 124 of the first rear pillar 108. A distal end 154 of the rear lateral support member 150 is connected with the fourth upper end 142 of the second rear pillar 116. As a result, air is allowed to flow between the first rear pillar 108 and the second rear pillar 116 via the second medial support member 140.

Figure 2:
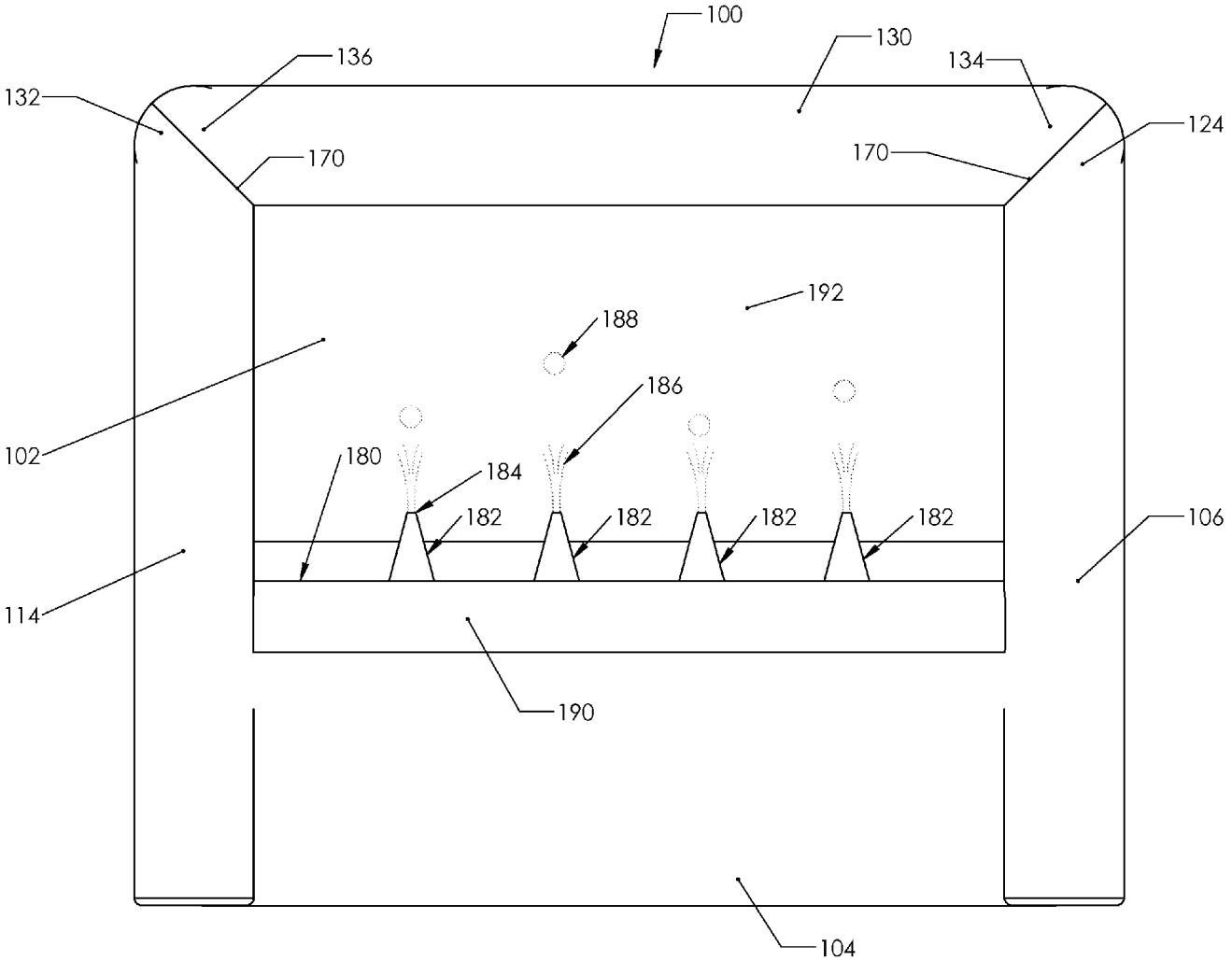
FIG. 2 illustrates a front view of the hover ball shooting gallery illustrated in FIG. 1.

Referring to FIG. 2, a front view of the shooting gallery 100 illustrated in FIG. 1 is depicted. As illustrated, in one form, the front lateral support member 130 is connected with the upper ends 124, 132 of the first and second pillars 106, 114 at a plurality of welding points or seams 170. Other manners are envisioned that could be used to connect the structures or members disclosed herein together that comprise the shooting gallery 100. It is important that whatever connection method is used, it needs to form an air tight seal between the respective structures or members. Although not specifically illustrated, the first medial support member 122 is connected with the upper ends of the first front pillar 106 and the first rear pillar 108 at a plurality of welding points or seams 170 as well. The second medial support member 140 is connected with the upper ends of the second front pillar 114 and the second rear pillar 116 at a plurality of welding points or seams 170. Further, the rear lateral support member 150 is connected with the upper ends of the first rear pillar 108 and the second rear pillar 116 at a plurality of weld points or seams 170.

Referring collectively to FIGS. 1 and 2, the base 104 includes an upper surface or floor 180 that has one or more air vents 182 protruding upwardly therefrom. In this form, the air vents 182 are cone-shaped air vents but other shapes may be used as well. An upper portion of the air vents 182 include an aperture 184 through which an air stream 186 flows when the shooting gallery 100 is operational. In this form, the air stream 186 is configured to cause a target or ball 188 to hover. Although four air vents 182 are illustrated in this form, it should be appreciated that one or more air vents 182 may be used in other forms.

Attached to the upper surface 180 of the base 104 is a ball stop 190. In this form, the ball stop 190 has a cylindrical configuration but other forms could be used in other embodiments. In this form, the ball stop 190 runs laterally from the first and second front pillars 106, 114. A back panel 192 is connected with the upper surface 180, the first and second rear pillars 108, 116, and the rear lateral support member 150. The back panel 192 keeps the balls 188 from being pushed out the rear of the shooting gallery 100 when struck.

Figure 3:
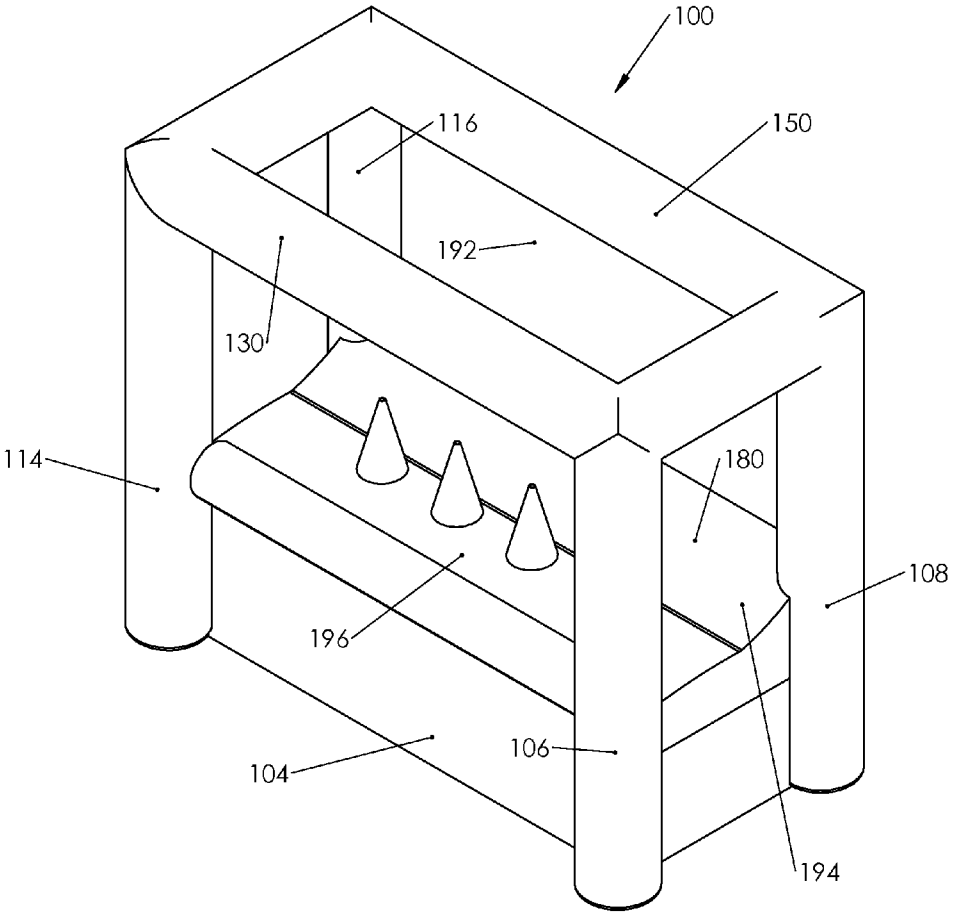
FIG. 3 illustrates a perspective view of another version of the hover ball archery shooting gallery.

Referring to FIG. 3, in another representative form, the upper surface or floor 180 includes a sloped portion 194. The sloped portion 194 tapers downwardly towards a flat portion 196. In this form, the balls 188 will bounce off the back panel 192 and roll down the sloped portion 194 to the flat portion 196.

Figure 4:
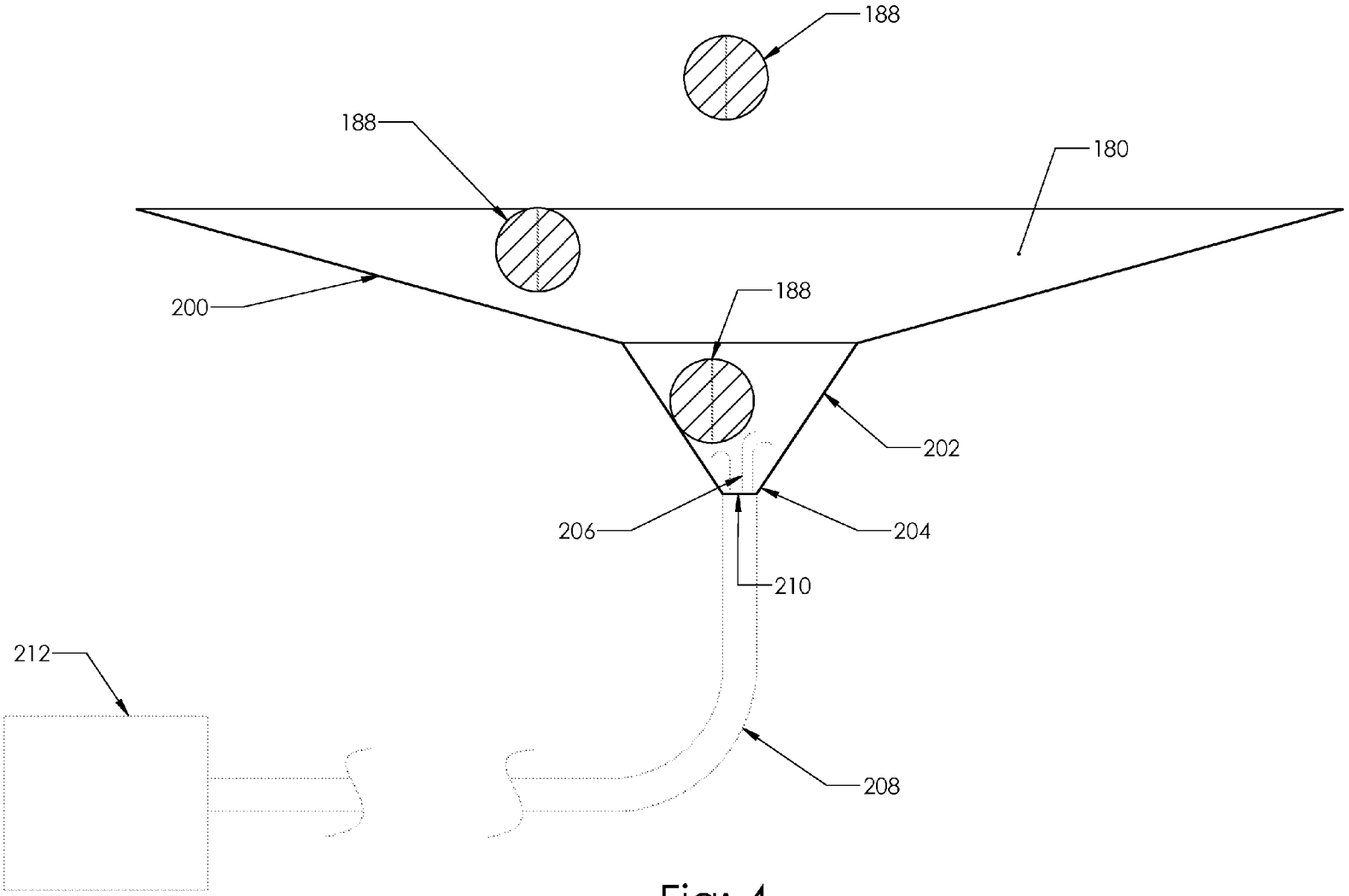
FIG. 4 illustrates a self-reloading version of the hover ball archery shooting gallery.

Referring to FIG. 4, in yet another form, the upper surface or floor 180 includes a first or upper stage funnel portion 200 and a second or lower stage funnel portion 202. In this form, the shooting gallery 100 does not include the air vents 182 as described in the previous embodiments. If a ball 188 is struck, it will make contact with the upper funnel shaped portion 200 and then be directed downward by gravity toward the lower funnel shaped portion 202. The downward slope or taper of the upper funnel shaped portion 200 causes the ball 188 to travel downwardly toward the lower funnel shaped portion 202. In this form, the upper and lower funnel shaped portions 200, 202 are cone shaped, but other shapes are envisioned as long as they cause the target 188 to travel downwardly toward the air stream described below.

Once the ball 188 reaches the lower funnel shaped portion 202, it will travel downwardly to a lower central portion 204 where it will come into contact with an air stream 206. The air stream 206 will cause the ball 188 to lift into the air and hover as illustrated. In this form, an air tube 208 is connected with an inlet 210 located at the lower central portion 204 of the lower cone shaped portion 202. As illustrated, an end of the air tube 208 is connected with a blower 212. The blower 212 is operable to blow air through the air tube 208 to cause the ball 188 to hover. In addition, the blower 212 is operable to inflate the shooting gallery 100. In versions in which multiple targets 188 are provided for users to shoot at, there will be a plurality of upper and lower stages 200, 202 located in the upper floor 180.

Figure 5:
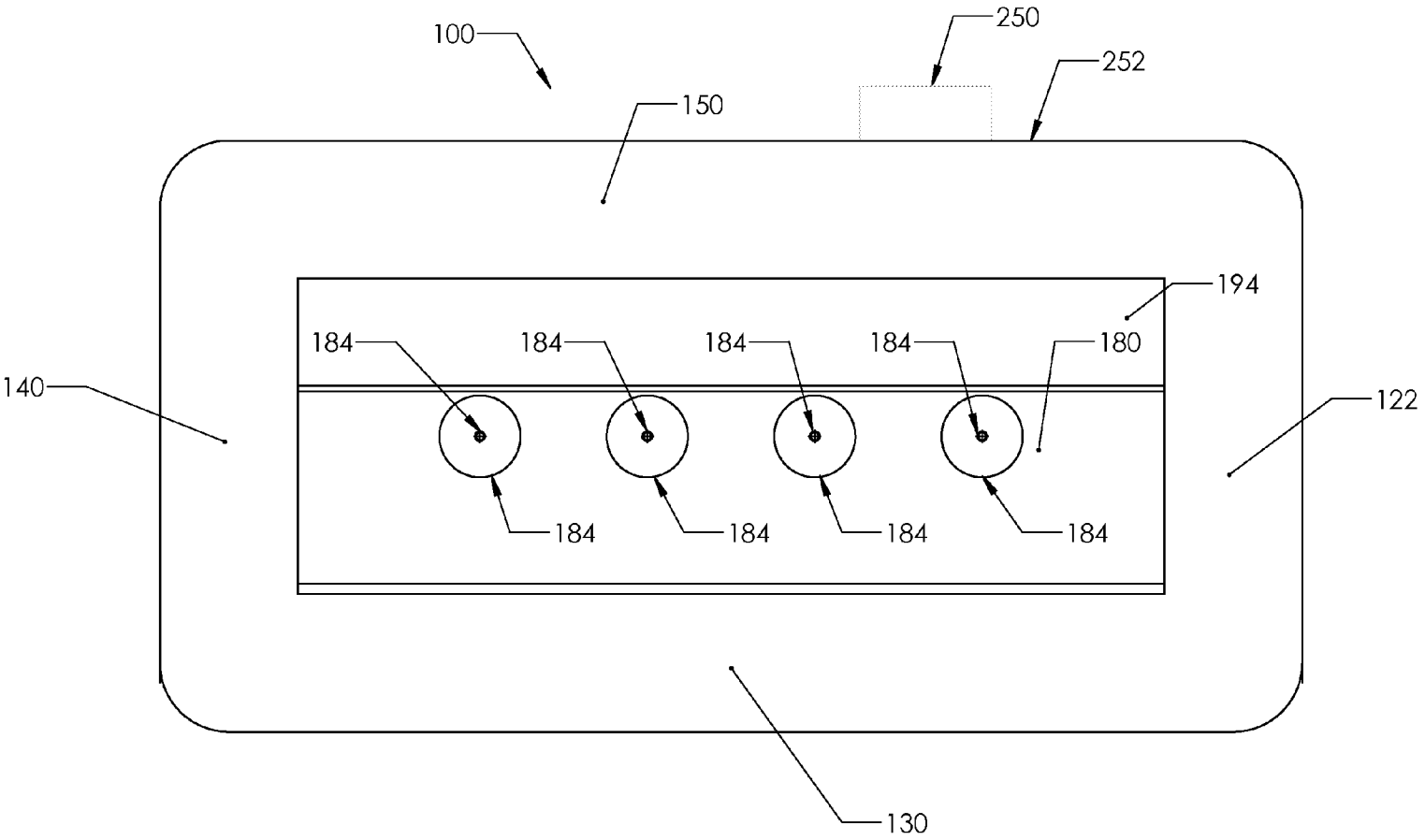
FIG. 5 shows a top view of the shooting gallery illustrated in FIG. 3 showing a blower connected with the hover ball shooting gallery.

Referring to FIG. 5, a top view of the shooting gallery 100 illustrated in FIG. 3 is depicted. The shooting gallery 100 includes a blower 250 that is used to inflate the shooting gallery 100. The base 104 of the shooting gallery 100 includes an air inlet 252 that is connected with an output of the blower 250. Once inflated, the air streams 186 depicted in FIG. 2 begin to flow through the apertures 184 in the cone shaped air vents 184. As a result, balls 188 can hover in the air streams 186 thereby providing targets for users to shoot at. In other forms, the blower 250 may be located within the base 104 thereby hiding it from view.

Figure 6:
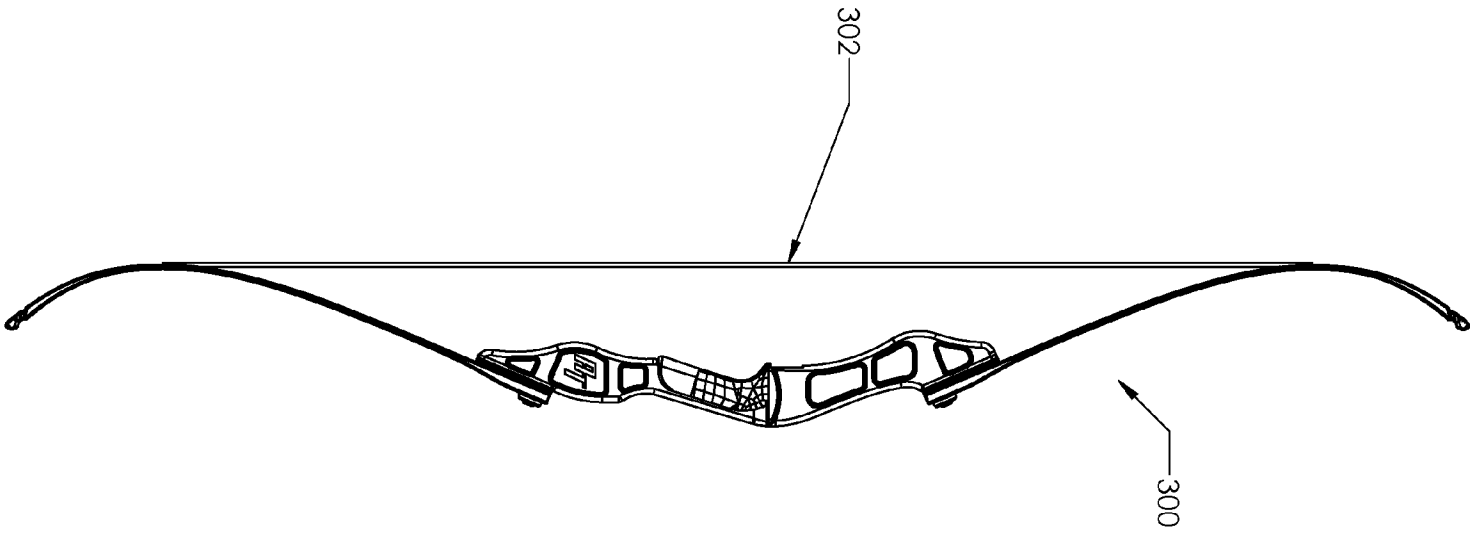
FIG. 6 illustrates a bow.
Figure 7:
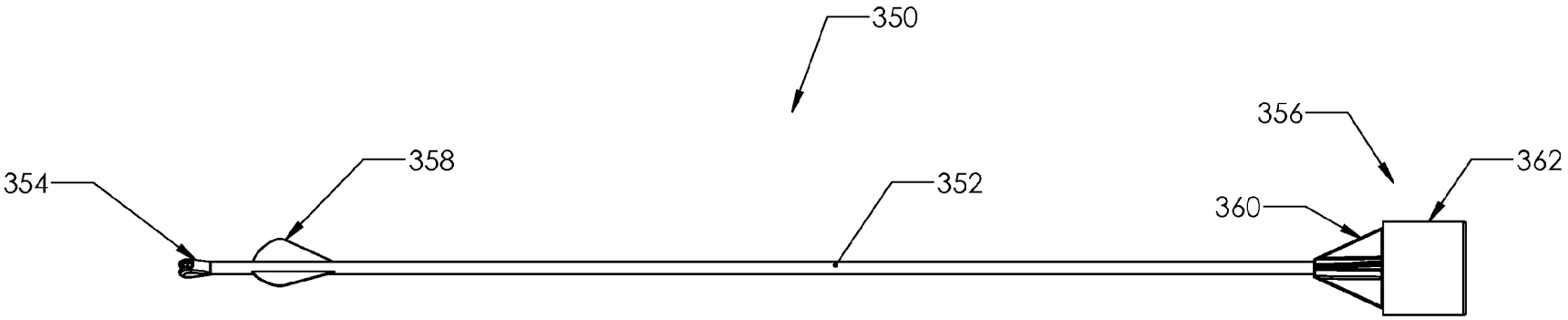
FIG. 7 illustrates a non-lethal arrow.

Referring to FIG. 6, a bow 300 is illustrated that is provided with the shooting gallery 100. The bow 300 could be selected from various bows known in the art. Referring to FIG. 7, a non-lethal arrow 350 is illustrated that is provided with the shooting gallery 100. In this form, the non-lethal arrow 350 includes a shaft 352 that extends along a longitudinal axis. A nock 354 is connected with a first end of the shaft 352 and a non-lethal arrow assembly 356 is connected to a second end of the shaft 352. The nock 354 includes a notch that is utilized to secure a bowstring 302 of the bow 300 to the arrow 350. In addition, near the first end of the arrow 350 is a fletching or vanes 358 that are attached to the shaft 352. The fletching 358 is used to aerodynamically stabilize the arrow 350 and may be made from a plurality of materials.

Figure 8:
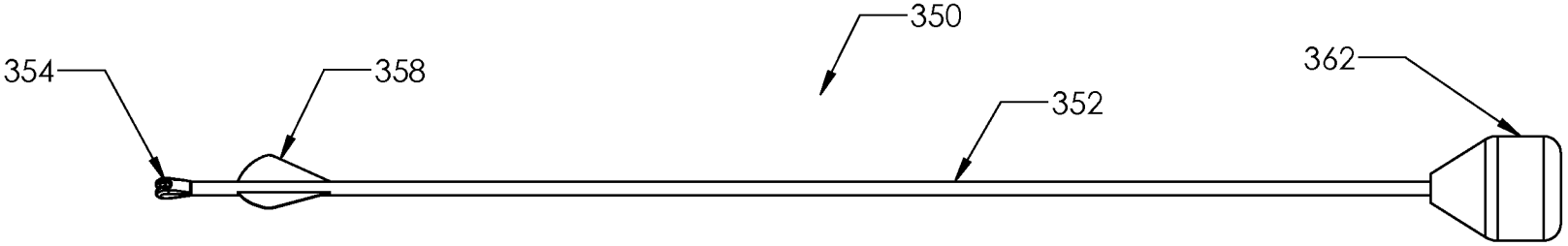
FIG. 8 illustrates another version of the non-lethal arrow.

The non-lethal arrow assembly 356 includes a tip connector 360 and a foam tip 362. The foam tip 362 is connected with the tip connector 360 and has a generally cylindrical shape. For a more detailed description of the non-lethal arrow 350, reference is made to commonly owned U.S. Pat. No. 8,449,413, which is incorporated herein by reference in its entirety. Referring to FIG. 8, in yet another form, the non-lethal arrow assembly 356 may include a foam tip 362 that is overmolded over the tip connector 360.

In one form, the shooting gallery 100 disclosed herein is provided as a kit. In this form, the kit comes with the shooting gallery 100, one or more targets 188, the bow 300, and one or more non-lethal arrows 350. The non-lethal arrows 350 are shot by a user with the bow 300 at the targets 188. Use of the non-lethal arrows 350 provides safety for the user as well as others who may be around the shooting gallery 100. The non-lethal arrows 350 will not injure people and also will not cause damage to the shooting gallery 100. The foam tips 362 are soft and will not injure anyone who may be inadvertently struck by the non-lethal arrow 350. The shooting gallery 100 provides a safe manner in which to teach users how to shoot with a bow 300.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A shooting gallery, comprising:

an inflatable structure comprising a base having an upper floor, a pair of front pillars extending upwardly from front ends of a front portion of said base, a pair of rear pillars extending upwardly from rear ends of a rear portion of said base, a first medial member connected with a first upper end of a respective one of said front pillars and a second upper end of an opposing respective one of said rear pillars, a second medial member connected with a third upper end of a respective one of said front pillars and a fourth upper end of an opposing respective one of said rear pillars, a front lateral member extending between and connected with said first upper end of said respective front pillar and said third upper end of said respective other front pillar, a rear lateral member extending between and connected with said second upper end of said respective rear pillar and said fourth upper end of said respective other rear pillar, and a back panel extending between and connected with said respective rear pillars;

at least one air vent located in said upper floor operable to generate an air stream;

at least one target configured to be placed in said air stream such that said target hovers in said air stream; and a blower operable to inflate said inflatable structure and cause said air stream to be emitted from said at least one air vent.

2. The shooting gallery of claim 1, wherein said at least one air vent comprises a cone-shaped air vent extending upwardly from said upper floor, wherein an aperture is located at a top of said cone-shaped air vent that is sized and configured to generate said air stream to cause said at least one target to hover.

3. The shooting gallery of claim 1, wherein said upper floor includes at least one upper funnel stage that slopes downwardly toward a lower funnel stage.

4. The shooting gallery of claim 3, wherein said lower funnel stage portion includes said at least one air vent, wherein said at least one air vent comprises an air inlet located in a lower portion of said lower funnel stage.

5. The shooting gallery of claim 4, wherein an air tube is connected with said air inlet and generates said air stream, wherein another end of said air tube is connected with said blower.

* * * * *